United States Patent [19]

Evrell

[11] Patent Number: 4,669,188

[45] Date of Patent: Jun. 2, 1987

[54] FOLDING KNIFE

[75] Inventor: Torbjörn Evrell, Eskilstuna, Sweden

[73] Assignee: Eskilstuna Knivfabriks AB, Sweden

[21] Appl. No.: 743,909

[22] Filed: Jun. 12, 1985

[30] Foreign Application Priority Data

Dec. 21, 1984 [SE] Sweden ..... 8406574

[51] Int. Cl.[4] ..... B26B 3/06

[52] U.S. Cl. ..... 30/161; 30/155; 30/151

[58] Field of Search ..... 30/155, 160, 161, 151, 30/340, 345, 346

[56] References Cited

U.S. PATENT DOCUMENTS

| | | | |
|---|---|---|---|
| 1,451,607 | 4/1923 | Bates | 30/161 |
| 3,783,509 | 1/1974 | Lake | 30/161 |
| 4,442,600 | 4/1984 | Felix-Dalichow | 30/161 |

*Primary Examiner*—E. R. Kazenske
*Assistant Examiner*—Willmon Fridie, Jr.
*Attorney, Agent, or Firm*—Nies, Webner, Kurz & Bergert

[57] ABSTRACT

A folding knife comprising a handle and a knife blade rotatable about a pivot. The invention is characterized by the combination that the handle (2) consists of only one wood piece, which is sawn open along a central longitudinal plane, so that a longitudinal gap (5) is formed along the greater part, but not along the entire length of the handle (2), that the blade pivot is located at the end (7) of the handle (2) where the gap (5) opens and is attached in the wood portions of the handle (2) located on opposite sides of the gap, and that a retaining mechanism known per se capable to retain the knife blade (4) in folded-out position and in a spring-loaded manner to retain the knife blade in folded-in position is provided. The retaining mechanism comprises a retaining arm (12) and a spring (13) acting against the same, which are mounted in the longitudinal gap (5) and have a thickness corresponding to the width of the gap (5).

3 Claims, 2 Drawing Figures

FOLDING KNIFE

This invention relates to a folding knife. Heretofore folding knives were manufactured in such a way, that one or several knife blades, spring mechanisms and possible retaining mechanisms were assembled by means of pivots, such as rivets or pins, extending between two parallel sheets. On the outward facing surfaces of these sheets wood members, metal members or plastic members were attached so as thereby to provide the folding knife with its final form and look.

Such folding knives, and especially such with wood members attached to the outward facing surfaces thereof, are expensive to manufacture, owing to the fact, that a relatively great number of components are to be manufactured, of which the side members of wood are relatively expensive to make, and that the mounting work is relatively comprehensive and, therefore, relatively expensive.

The present invention relates to a folding knife, which is substantially simpler as to its structure and thereby a.o. less expensive to manufacture, but the performance of which corresponds fully to that of more complicated knives.

The present invention, thus, relates to a folding knife comprising a handle and a blade rotatable about a pivot. The invention is characterized by the combination, that the handle consists of only one wood member, which is sawn along a central longitudinal plane so, that a longitudinal gap is formed along the greater part, but not along the entire length of the handle, that the blade pivot is located at the handle end where the gap opens and is fixed in the wood portions of the handle located on opposite sides of the gap, and that a retaining mechanism capable to lock the knife blade in folded-out position and in spring-loaded manner to retain the knife blade in folded-in position is provided, which comprises a retaining arm and a spring acting against the same, which are mounted in the longitudinal gap and have a thickness corresponding to the gap width.

Figure 1:
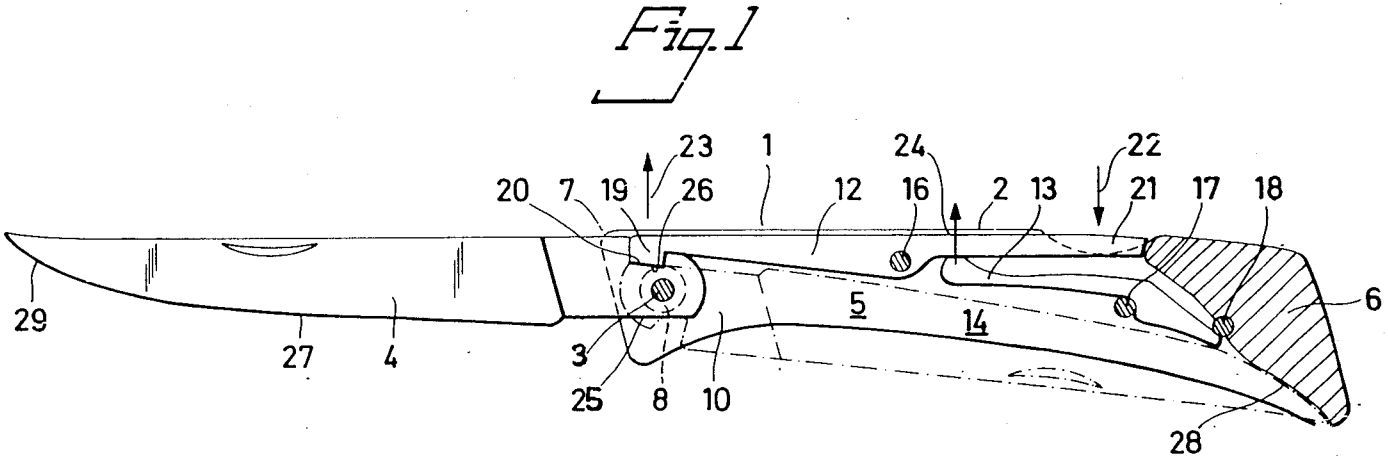
Figure 2:
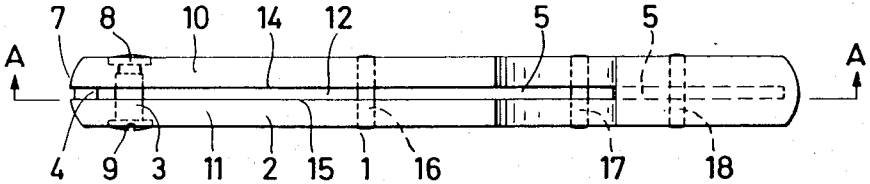

The inventtion is described in greater detail in the following with reference to an embodiment thereof shown in the accompanying drawing, in which FIG. 1 is a sectional view after the line A—A in FIG. 2 of a folding knife according to the invention, with folded-out blade, and FIG. 2 is a view from above of the folding knife, with folded-in blade.

In FIGS. 1 and 2 a folding knife 1 is shown comprising a handle 2 and a knife blade 4 rotatable about a pivot 3. According to the invention, the handle 2 consists of only one single piece elongate wood member which is sawn open from one end along a central longitudinal plane so, that a longitudinal gap 5 is formed along the greater part, but not along the entire length of the handle. As appears from FIG. 1, only the rear portion 6 of the handle, shown by hatched lines has not been sawn open. As appears from FIG. 2, the gap has uniform width. The dashed portion of the gap 5 in FIG. 2 extends to the farthest right-hand end of the gap in FIG. 1.

The pivot 3 is located at the end 7 of the handle 2 where the gap 5 opens. The pivot comprises a screw 8 threaded into a sleeve 9. These parts are attached in the wood portions 10,11 of the handle 2 located on opposite sides of the gap. A retaining mechanism is provided and capable to retain the knife blade 4 in folded-out position and in a spring-loaded manner to retain the knife blade in folded-in position. The retaining mechanism comprises a retaining arm 12 and a spring 13 acting against the same.

According to the invention, the retaining mechanism is designed so that the retaining arm 12 and spring 13 have a thickness corresponding to the width of the gap 5. The retaining arm 12 and spring 13 are mounted in the gap 5. The lateral surfaces 14,15 of the wood portions 10,11 facing toward the gap 5, thus, constitute guide surfaces for the retaining arm 12 as well as for the spring 13.

Due to the blade pivot 3 being located near to the opening of the gap 5, and the screw 8 and sleeve 9 holding together the free ends of the wood side portions 10,11 against the knife blade 4 located therebetween, the width of the sawn-open gap 5 remains constant.

The present invention, in its broadest sense, is a combination of designing the handle 2 made from a single wood piece and to saw open therein a gap 5, to position the pivot 3 at the end 7 of the handle 2 where the gap 5 opens and to attach said pivot between the ends of the wood side portions, further to provide a retaining mechanism generally found in such folding knives in the gap 5 where the components comprised have a thickness corresponding to the thickness of the gap.

By this combination the aforesaid conventional sheets arranged in parallel are eliminated. Furthermore, only one wood piece is to be manufactured instead of two reversed wood side pieces. The number of components to be manufactured and mounted, thus, is reduced. It is apparent that the present invention implies a substantially simplified design of a folding knife compared with conventional folding knives. In spite of the simplifications, however, the performance, such as strength, torsional strength, reliability in operation etc., corresponds to that of a conventionally designed folding knife. Due to the invention, thus, a substantial simplification has been achieved without giving rise to any proper disvantage.

According to a preferred embodiment of the invention, the retaining arm 12 is rotatable about an axle pin 16, and the spring 13 is clamped between two clamping members consisting of two pins or axles 17,18 which are spaced from one another and disposed across the slot near the rear end of the handle. The said three axles are inserted into holes drilled in said wood side portions 10,11 on opposite sides of the gap 5. The diameter of the holes exceeds the diameter of the axles 16,17,18 by only about 0.05 mm. Due to the fact that the spring 13 and retaining arm 12 abut each other and the respective axle 17,18 and 16 with a certain force produced by the spring 13, the axles are retained in place. This design contributes to an extremely simple and quick mounting of the folding knife, compared with the known technique, at which rivets are fixed in the aforesaid parallel sheets.

The retaining arm 12 comprises at one end a shoulder 19 for co-operation with a corresponding groove 20 in the knife blade 4. The retaining arm 12 is actuated by pressing its other end 21 down some distance in the direction of the arrow 22. Hereby the shoulder 19 is lifted out of engagement with the groove 20 in the direction of the arrow 23. The pressing down of the retaining arm is effected against the spring action exerted by the spring 13 in the direction of the arrow 24. A retaining mechanism comprising such a retaining arm and spring is per se previously known.

In FIG. 1 the knife blade 4 is shown in folded-in position by dash-dotted lines. In folded-in position the plane surface 25 (marked on the folded-out blade) of the knife blade co-operates with the plane surface 26 of the shoulder 19, so that the knife blade resiliently is retained in the gap 5. As appears from FIG. 1, the cutting edge 27 of the entire knife blade 4 is in the gap when the blade is in folded-in position.

According to another preferred embodiment of the invention, the gap end opposite the gap opening comprises a limiting surface 28 of the handle portion 6 which is not sawn open, the form of which corresponds to the leading portion 29 of the cutting edge of the knife blade 4. The leading portion 29 of the cutting edge is intended to rest against this limiting surface 28 when the knife blade is in its most folded-in position. Owing to this design, the cutting edge of the blade in folded-in position cannot get into contact with metal objects in the gap.

All components except the handle are of metal. The knife blade and retaining mechanism consist of expedient steel grades.

The axles 16,17,18 and pivot 3 can be manufactured of a suitable brass quality or alternatively of steel. The handle 2 can consist of any suitable sort of wood.

The present invention, of course, can be modified in respect of among other things the design of the retaining mechanism. The handle, further, can be sawn open to a lesser extent than shown in the accompanying drawing.

The present invention, thus, must not be regarded restricted to the embodiments set forth above by way of example, but can be varied within the scope of the attached claims.

What is claimed is:

1. A folding knife comprising a handle and a knife blade rotatable about a pivot, characterized by the combination wherein the handle (2) consists of only one integral elongate wood piece with two ends, which is sawn open from one end along a central longitudinal plane so that a longitudinal gap (5) is formed along the major part, but not along the entire length of the handle (2), providing two wood side portions integral at the other end of said handle, that said pivot (3) is located at the said one end (7) of the handle (2) where the gap (5) opens and is attached in the two wood side portions (10,11) of the handle (2) located on opposite sides of the gap (5), a retaining mechanism capable to retain the knife blade (4) in folded-out position and in a spring-loaded manner to retain the knife blade in folded-in position comprising a retaining arm (12) and a spring (13), acting against the arm, which arm and spring are mounted in said gap (5) and each has a thickness corresponding to the width of the gap (5), said retaining mechanism also including an axle pin across said gap intermediate the two ends of said handle providing a pivot means mounting said retaining arm, and two abutment means mounted in said handle side pieces across said gap and at spaced apart locations between said axle pin and said other end of said handle, and wherein said spring is elongate and imperforate and includes one end abutting said retaining means and a portion adjacent its other end including upper and lower opposed fulcrums respectively engaging and bearing in opposed directions against associated said abutment means to thereby clamp said spring within said gap with its said one end providing a spring bias against said retaining arm.

2. A folding knife as defined in claim 1, wherein said two abutment means are second and third axle pins inserted into holes in said wood side portions located on opposite sides of said gap and said two spring fulcrums are shaped to interlock in opposed directions between and against said second and third axle pins when the other end of said spring is in spring biased engagement with said retaining arm.

3. A folding knife as defined in claim 1 or 2, characterized in that the gap end opposite to its opening comprises a limiting surface (28) of the handle end portion (6) not sawn open, which limiting surface (28) has a form corresponding to the leading portion (29) of the cutting edge of the knife blade (4), against which limiting surface (28) the said leading portion (29) is intended to rest in folded-in position of the knife blade (4).

* * * * *